US009522291B2

(12) United States Patent
Fukuhara

(10) Patent No.: US 9,522,291 B2
(45) Date of Patent: Dec. 20, 2016

(54) FIRE EXTINGUISHING APPARATUS

(71) Applicant: NGK Insulators, Ltd., Nagoya (JP)

(72) Inventor: Motohiro Fukuhara, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 14/561,343

(22) Filed: Dec. 5, 2014

(65) Prior Publication Data

US 2015/0083446 A1 Mar. 26, 2015

Related U.S. Application Data

(63) Continuation of application No. PCT/JP2013/067533, filed on Jun. 26, 2013.

(30) Foreign Application Priority Data

Jul. 13, 2012 (JP) ..... 2012-157257

(51) Int. Cl.
*A62C 13/00* (2006.01)
*A62C 13/70* (2006.01)
(Continued)

(52) U.S. Cl.
CPC ..... *A62C 13/70* (2013.01); *A62C 13/006* (2013.01); *A62C 13/72* (2013.01);
(Continued)

(58) Field of Classification Search
CPC .... A62C 13/006; A62C 13/70; A62C 99/0045
(Continued)

(56) References Cited

U.S. PATENT DOCUMENTS 1,839,658 A * 1/1932 Dugas ..... A62C 13/006 169/15
5,810,089 A * 9/1998 Mack ..... A62C 8/00 169/15
6,024,304 A 2/2000 Sawada

FOREIGN PATENT DOCUMENTS

DE 102006019739 A1 10/2007
FR 2371207 A1 6/1978
(Continued)

OTHER PUBLICATIONS

International Search Report (Application No. PCT/JP2013/067533) dated Sep. 3, 2013.
(Continued)

*Primary Examiner* — Arthur O Hall
*Assistant Examiner* — Viet Le
(74) *Attorney, Agent, or Firm* — Burr & Brown, PLLC

(57) ABSTRACT

The present invention provides a fire extinguishing apparatus being inexpensive in manufacturing cost, easy to handle, and it enables a storage tank to be refilled with fire extinguishing sand during a fire extinguishing. A fire extinguishing apparatus of the present invention includes a sand container having fire extinguishing sand a nitrogen gas cylinder, and an ejector provided nitrogen gas taken out via a decompression valve from the nitrogen gas cylinder. The ejector is connected to a suction tube sucking the fire extinguishing sand from the sand container using negative pressure generated by a nitrogen gas stream and a delivery tube delivering the sucked fire extinguishing sand and the nitrogen gas. The sand container has a lid plate provided with a sand inlet enabling opening and closing, which enables the sand container to be refilled with the fire extinguishing sand during a fire extinguishing.

3 Claims, 5 Drawing Sheets

(51) Int. Cl.

| | |
|---|---|
| ***A62C 99/00*** | (2010.01) |
| ***A62C 13/72*** | (2006.01) |
| *A62C 3/06* | (2006.01) |
| *A62C 3/16* | (2006.01) |

(52) U.S. Cl.
CPC ..... *A62C 99/0045* (2013.01); *A62C 3/06* (2013.01); *A62C 3/16* (2013.01)

(58) Field of Classification Search
USPC ..... 169/15, 27, 85
See application file for complete search history.

(56) References Cited

FOREIGN PATENT DOCUMENTS

| | | | |
|---|---|---|---|
| GB | 254195 | | 7/1926 |
| JP | 03-100222 | U | 10/1991 |
| JP | 04-300564 | A | 10/1992 |
| JP | 05-84319 | A | 4/1993 |
| JP | 06-269509 | A1 | 9/1994 |
| JP | 07-165333 | A1 | 6/1995 |
| JP | 09-000653 | A1 | 1/1997 |
| JP | 09-154971 | A1 | 6/1997 |
| JP | 2006-025806 | A1 | 2/2006 |
| SU | 822686 | A | 11/1991 |

OTHER PUBLICATIONS

Chinese Office Action (Application No. 201380028977.8) dated Mar. 2, 2016.
European Search Report, European Application No. 13816905.7, dated Nov. 11, 2015 (7 pages).
Japanese Office Action (With English Translation), Japanese Application No. 2014-524729, dated Nov. 1, 2016 (6 pages).

* cited by examiner

FIRE EXTINGUISHING APPARATUS

BACKGROUND OF THE INVENTION

Field of the Invention

The present invention relates to a fire extinguishing apparatus suitable for fire extinction for a fire extinguishing object such as a high-temperature operable battery.

Description of Related Art

A battery system using sodium-sulfur batteries is constituted by combination of multiple battery modules each housing hundreds of battery cells in a thermal insulating enclosure. In case of firing of such a battery module, hot molten material of sodium and sulfur blows out to a ceiling surface of the thermal insulating enclosure, and when the hot molten material contacts air, a severe oxidation reaction occurs, which may cause enlargement of the fire. Since fire extinction with water is impossible due to existence of sodium, fire extinction by suffocation, in which air is shut off with use of fire extinguishing sand, is required. This battery charge system using the sodium-sulfur batteries may be several meters in height in a case of adopting a structure in which a plurality of battery modules are piled. Accordingly, a fire extinguishing apparatus is required to have ability to raise the fire extinguishing sand as high as several meters and spray it.

Patent Document 1 filed by the present applicant describes a fire extinguishing apparatus adapted to spray ceramic particles to an object under fire extinction. This apparatus has a structure in which the ceramic particles are housed in a storage tank and are delivered from a bottom portion of the storage tank with use of gas pressure applied to the storage tank from a gas cylinder.

However, in this apparatus, the storage tank has to be a pressure container since the storage tank needs to be pressurized at high pressure, which causes a problem of an increase in manufacturing cost and non-easy handling. Also, since the storage tank cannot be refilled with fire extinguishing sand during a fire extinguishing work, the amount of the fire extinguishing sand may be insufficient depending on the fire scale.

PRIOR ART DOCUMENT

Patent Document

Patent Document 1: JP 06-269509 A

SUMMARY OF THE INVENTION

An object of the present invention is to solve the aforementioned conventional problems and to provide a fire extinguishing apparatus which is inexpensive in manufacturing cost, is easy to handle, and enables a storage tank to be refilled with fire extinguishing sand during a fire extinguishing work.

To solve the above problems, a fire extinguishing apparatus according to a first aspect of the present invention includes a sand container in which fire extinguishing sand is housed, a nitrogen gas cylinder, and an ejector to which nitrogen gas taken out via a decompression valve from the nitrogen gas cylinder is supplied. The ejector is connected to a suction tube sucking the fire extinguishing sand from the sand container with use of negative pressure generated due to a nitrogen gas stream and a delivery tube delivering the sucked fire extinguishing sand as well as the nitrogen gas.

The sand container has a lid plate thereof provided with a sand inlet enabling opening and closing.

Meanwhile, according to a second aspect of the present invention, the suction tube is preferably arranged at a position deviating from a center of the sand container. Also, according to a third aspect of the present invention, the fire extinguishing apparatus preferably includes a nitrogen enclosing tube further reducing pressure of the nitrogen gas taken out via the decompression valve from the nitrogen gas cylinder and supplying the nitrogen gas into an inside of the sand container. Also, according to a fourth aspect of the present invention, the fire extinguishing sand is preferably expanded vermiculite. Further, according to a fifth aspect of the present invention, the sand container, the nitrogen gas cylinder, and the ejector are preferably mounted on a movable carriage.

The fire extinguishing apparatus according to the present invention generates the negative pressure in the ejector due to the nitrogen gas stream, sucks the fire extinguishing sand from the sand container with use of this negative pressure, and delivers the fire extinguishing sand as well as the nitrogen gas. Thus, the sand container does not need to be a pressure container, and the fire extinguishing apparatus is easy to manufacture and handle. Also, since the sand container can be refilled with the fire extinguishing sand through the sand inlet during a fire extinguishing work as needed, a shortage of sand does not occur during the fire extinguishing work.

According to the second aspect of the present invention, since the suction tube is arranged at the position deviating from the center of the sand container, a blocking phenomenon of the fire extinguishing sand hardly occurs in the inside of the sand container, and the fire extinguishing sand can be delivered continuously.

According to the third aspect of the present invention, since the fire extinguishing apparatus includes the nitrogen enclosing tube further reducing pressure of the nitrogen gas taken out via the decompression valve from the nitrogen gas cylinder and supplying the nitrogen gas into the inside of the sand container, the fire extinguishing sand stored in the inside of the sand container will not contact air, which can prevent moisture absorption and deterioration of the fire extinguishing sand.

According to the fourth aspect of the present invention, since the fire extinguishing sand is the expanded vermiculite, the fire extinguishing sand is easily sprayed to a high position along with the nitrogen gas stream due to low bulk specific gravity and easily forms an air blocking layer at a deposited position. Accordingly, an excellent fire extinguishing effect can be obtained even in a case in which a firing source is located at a high position.

Further, according to the fifth aspect of the present invention, since the sand container, the nitrogen gas cylinder, and the ejector are mounted on the movable carriage, the fire extinguishing apparatus can be moved easily when a fire occurs. Also, since the fire extinguishing apparatus does not require a power source, the fire extinguishing work can be started immediately.

DETAILED DESCRIPTION OF THE INVENTION

Hereinbelow, preferred embodiments of the present invention will be described.

Figure 1:
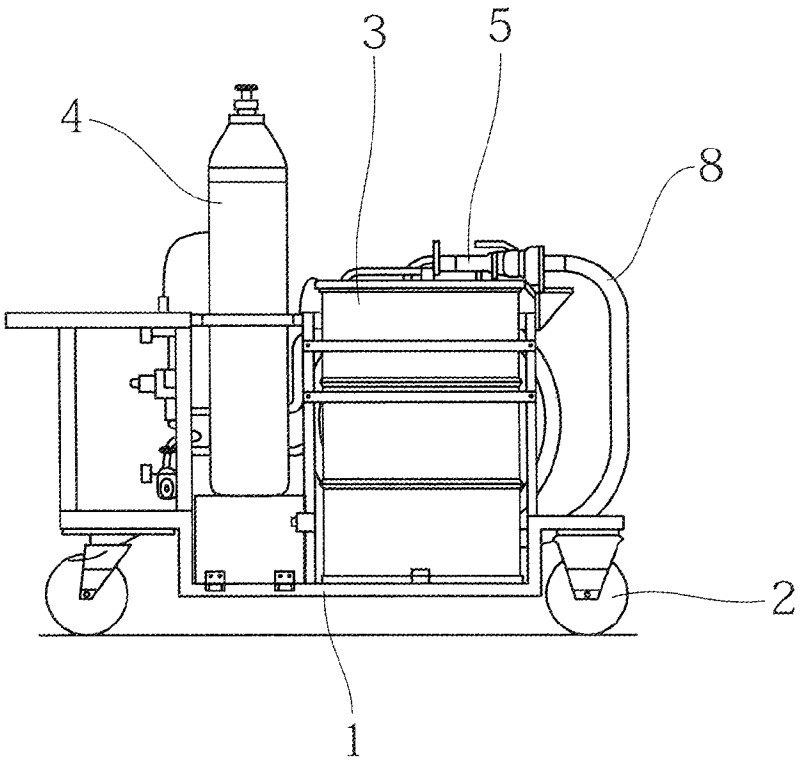
FIG. 1 is a front view of a fire extinguishing apparatus according to an embodiment of the present invention.
Figure 2:
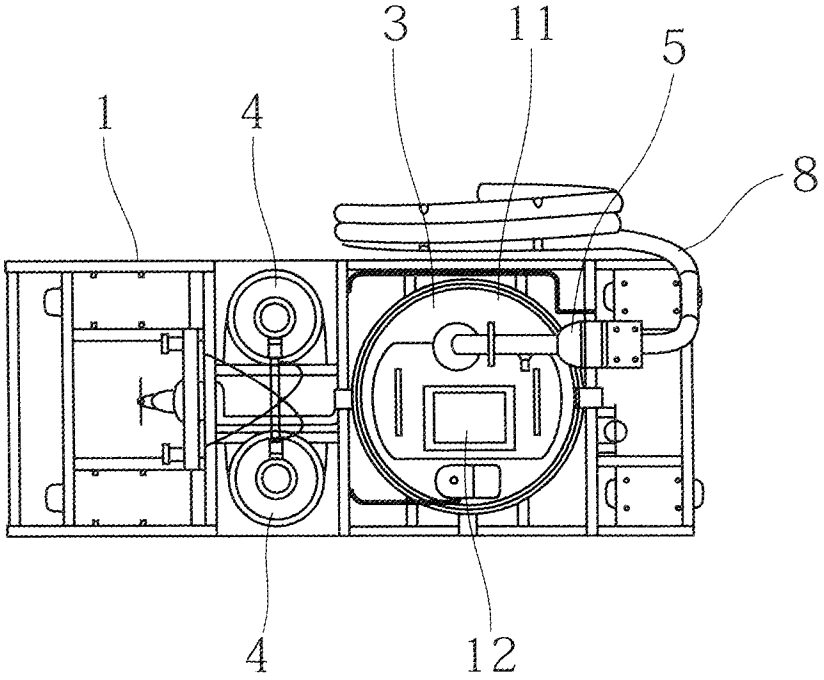
FIG. 2 is a plan view of the fire extinguishing apparatus according to the embodiment of the present invention.
Figure 3:
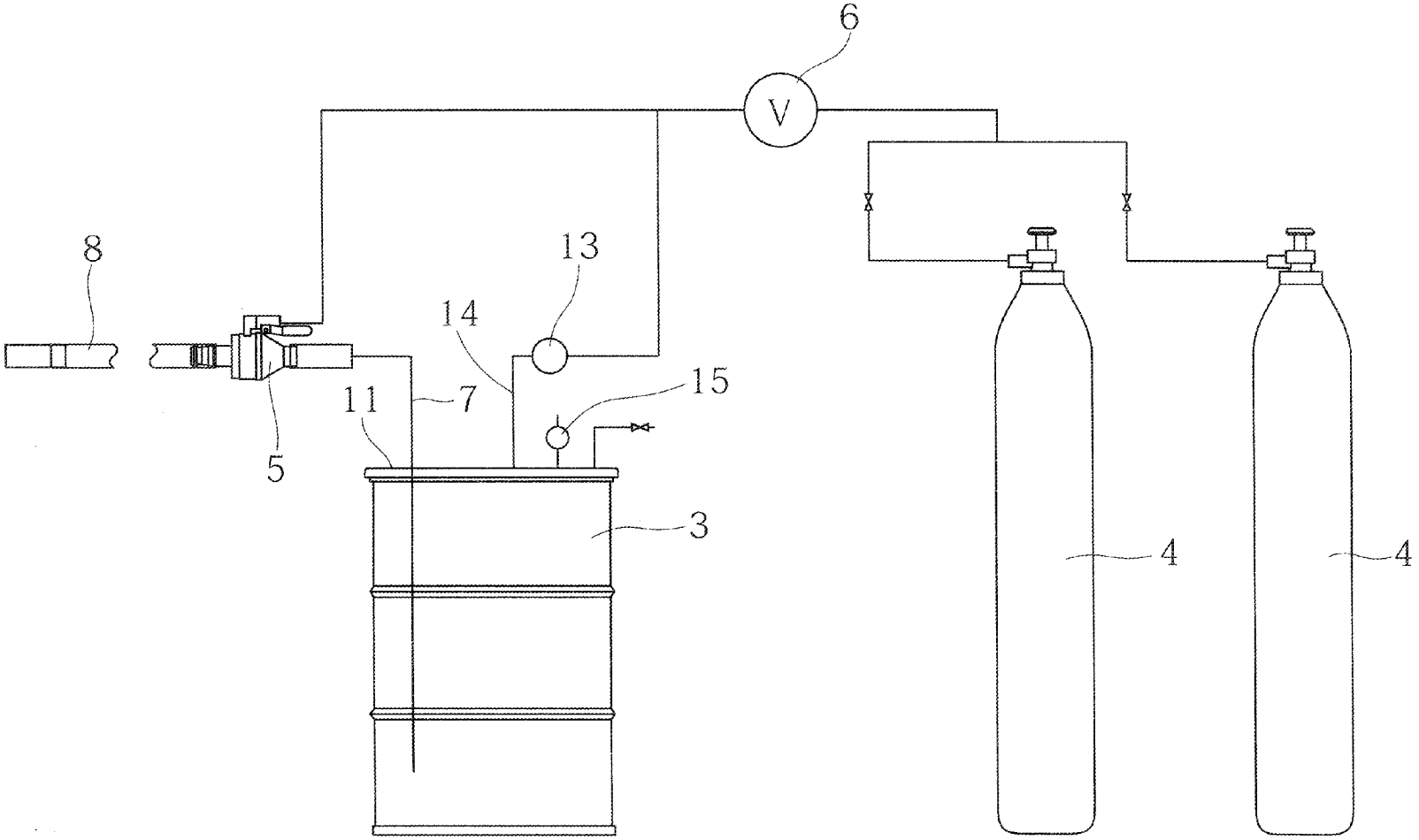
FIG. 3 is a piping system view.

FIG. 1 is a front view of a fire extinguishing apparatus according to an embodiment of the present invention, FIG. 2 is a plan view thereof, and FIG. 3 is a piping system view. In FIGS. 1 and 2, reference sign 1 denotes a movable carriage including running wheels 2, on which a sand container 3, nitrogen gas cylinders 4, and an ejector 5 are mounted.

In the present invention, the sand container 3 is a drum container, in which expanded vermiculite as fire extinguishing sand is housed. The capacity of a general drum container is 200 L, but to prevent a blocking phenomenon from occurring inside, the filling amount of the expanded vermiculite is preferably less than the capacity. The expanded vermiculite has low bulk specific gravity and has a feature of expanding and forming an air blocking layer when heat is applied. Based on an experiment, depositing the vermiculite as high as about 3 cm can bring about a sufficient fire extinguishing effect. A particle diameter of the fire extinguishing sand is preferably about 3 to 5 mm. The reason for this is that the sand with a shorter particle diameter than it may be difficult to fly on gas stream while the sand with a longer particle diameter than it may cause a nozzle or the like to be clogged. However, the fire extinguishing sand is not limited to the expanded vermiculite.

In the present invention, the two nitrogen gas cylinders 4 are mounted. The reason for this is to avoid danger in which gas pressure decreases during a fire extinguishing work to disable fire extinction, and one of them is a spare cylinder. As each of the nitrogen gas cylinders 4, a commercial product with a capacity of 47 L and with primary pressure of 14.7 MPa can be used. These nitrogen gas cylinders 4 are connected to a decompression valve 6 illustrated in FIG. 3, and nitrogen gas is decompressed to about 0.3 MPa and is then supplied to the ejector 5.

Figure 4:
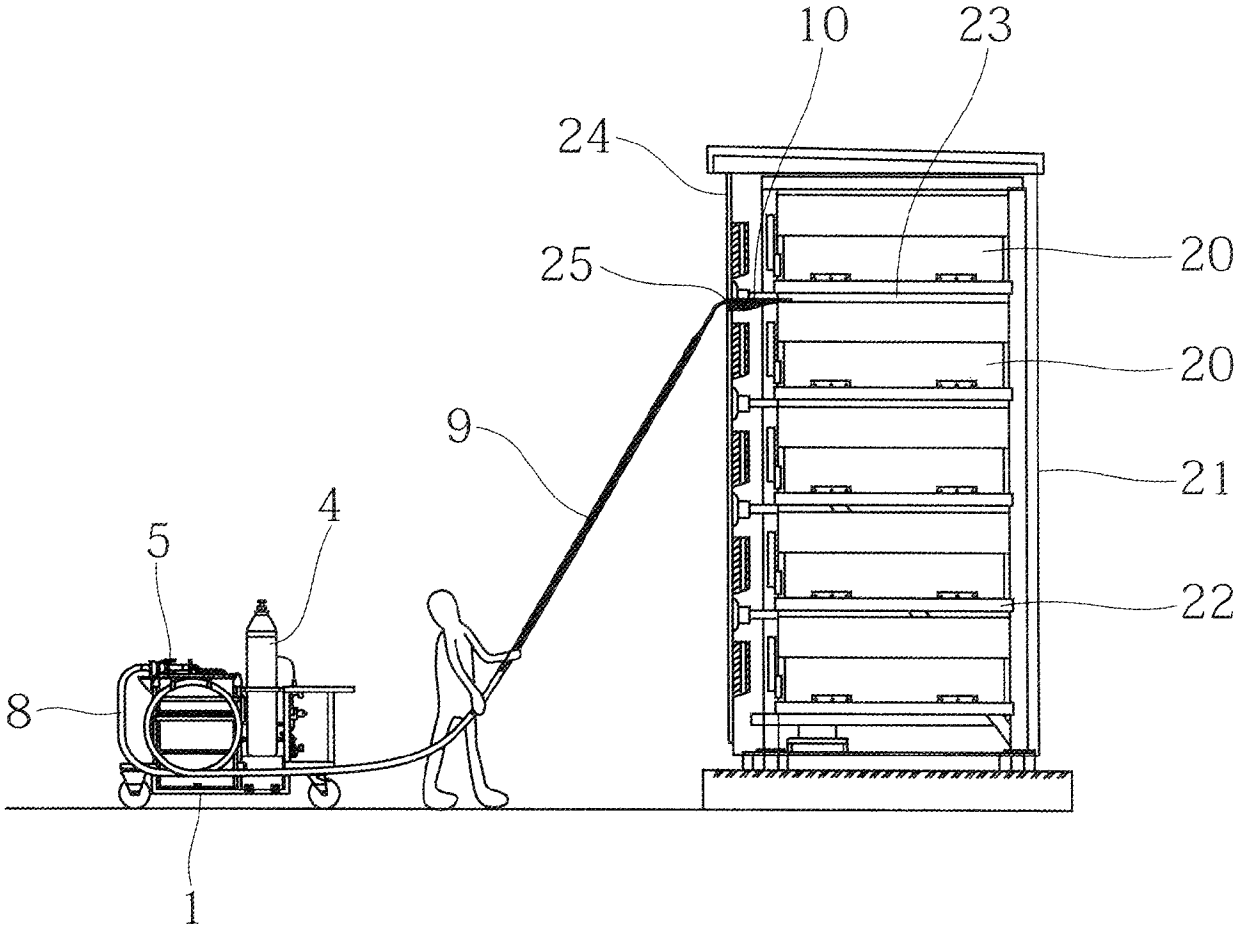
FIG. 4 describes a use state of the fire extinguishing apparatus according to the present invention.
Figure 5:
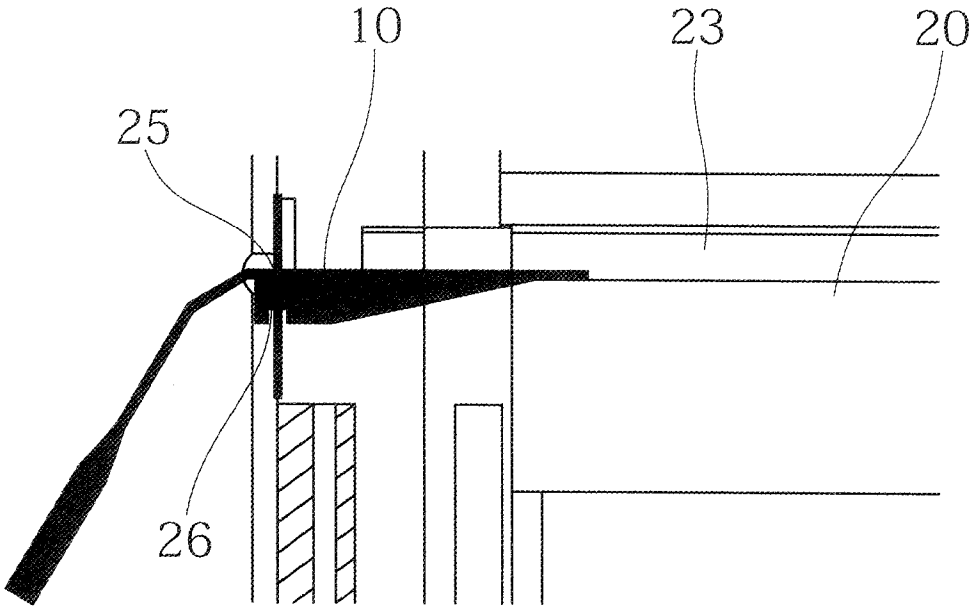
FIG. 5 is an enlarged view of a nozzle part.

The ejector 5 generates negative pressure due to the supplied nitrogen gas stream. Thus, by connecting a suction tube 7 to a base portion of the ejector 5 and inserting a tip end thereof deeply into the sand container 3, the fire extinguishing sand can be sucked from the inside of the sand container 3. To a tip end of the ejector 5 is connected a delivery tube 8, and the sucked fire extinguishing sand is delivered to the delivery tube 8 along with the nitrogen gas stream. As illustrated in FIG. 4, to a tip end of the delivery tube 8 are connected a metallic pipe 9 and a nozzle 10, and the fire extinguishing sand as well as the nitrogen gas can be sprayed from a tip end of the nozzle 10. To raise the fire extinguishing sand as high as 5 m and spray it, the flow rate of the nitrogen gas to be supplied to the ejector 5 is preferably 700 L per minute or more.

As illustrated in FIG. 3, the suction tube 7 is preferably arranged at a position deviating to one side from the center of the sand container 3. Locating the suction tube 7 at the center of the sand container 3 easily causes blocking because the suction tube 7 sucks the fire extinguishing sand uniformly from the periphery, but locating the suction tube 7 at an eccentric position hardly causes blocking because of the imbalance and enables the fire extinguishing sand to be delivered continuously.

On a lid plate 11 of the sand container 3 is formed a sand inlet 12 as illustrated in FIG. 2. Both the lid plate 11 and the sand inlet 12 are airtight lids with packing and can be opened as needed. Accordingly, the sand inlet 12 can be opened to refill the sand container 3 with the fire extinguishing sand during the fire extinguishing work, and a shortage of sand does not occur during the fire extinguishing work. Although such refilling during the fire extinguishing work is impossible in a conventional pressure-container-type fire extinguishing apparatus, the refilling is possible in the suction-type fire extinguishing apparatus according to the present invention, which is a great advantage for the fire extinguishing apparatus according to the present invention.

Meanwhile, the fire extinguishing sand represented by expanded vermiculite tends to be solidified by atmospheric humidity and may not be sucked smoothly by the suction tube 7 when the sand is lowered in dispersion property due to moisture absorption. Normally, the fire extinguishing apparatus of this kind is not used for a long time and would be worthless if the fire extinguishing sand was solid in case of fire. To avoid this situation, it is preferable to bifurcate an outlet side of the decompression valve 6, reduce the pressure by a pressure regulating valve 13 to pressure slightly higher than atmospheric pressure, and supply the nitrogen gas into the inside of the sand container 3 through a nitrogen enclosing tube 14 as illustrated in FIG. 3. By doing so, the inside of the sand container 3 is filled with the nitrogen gas, and troubles such as solidification and deterioration of the fire extinguishing sand can be prevented reliably. Also, the lid plate 11 of the sand container 3 is provided with a relief valve 15, and the relief valve 15 lets the nitrogen gas outside in a case in which the internal pressure rises abnormally to avoid danger of a breach.

FIG. 4 illustrates a state of using the fire extinguishing apparatus according to the present invention for fire extinction of a battery system using sodium-sulfur batteries. The battery charge system using the sodium-sulfur batteries is constituted by combination of multiple battery modules 20 in accordance with the charging capacity. Each of the battery modules 20 is a rectangular solid having a width and a depth of approximately 1.5 m and a height of approximately 0.8 m, and the battery modules 20 are housed in a rack 21 having a total height of nearly 5 m in a multistage manner. A flattened upper space 23 having a height of no more than 5 cm or so is formed between a floor plate 22 of the rack 21 and a ceiling surface of the battery module 20.

Doors 24 are arranged on a front face of the rack 21, and horizontally long openings 25 are formed at positions corresponding to the respective upper spaces 23.

As illustrated in FIG. 4, as many metallic pipes 9 as the appropriate number are connected to the tip end of the delivery tube 8 in accordance with the height of a firing source, the nozzle 10 attached to a tip end of the metallic pipe 9 is inserted into the opening 25 of the door 24, and the fire extinguishing sand is emitted into the upper space 23. Meanwhile, the nozzle 10 includes a guide plate 27 having a positioning recess 26 on a lower surface thereof, and by inserting the nozzle 10 into the opening 25 and then pushing the nozzle 10 to a back side, the nozzle 10 can be positioned at a position at which the positioning recess 26 is engaged with a lower edge of the opening 25. Accordingly, a reliable fire extinguishing work can be performed even in a case in which the firing source is located at a high position.

In this manner, the metallic pipes 9 are prepared so that as many metallic pipes 9 as the appropriate number can be sequentially added and used in accordance with the height of the firing source. To do so, it is preferable to mount several metallic pipes 9 on the movable carriage 1 so that the metallic pipes 9 can be used immediately.

In the fire extinguishing apparatus configured as above, by moving the fire extinguishing apparatus close to the firing source and an opening valve of the nitrogen gas cylinder 4 in case of fire, the ejector 5 generates negative pressure due to the nitrogen gas stream and sucks the fire extinguishing sand from the inside of the sand container 3. The sucked fire extinguishing sand is delivered to the delivery tube 8 along with the nitrogen gas stream and can be sprayed from the tip end of the nozzle 10 together with the nitrogen gas. The fire extinguishing sand covers a surface of an object under fire extinction to shut off air, and the fire can be extinguished. As described above, since the sand inlet 12 can be opened to refill the sand container 3 with the fire extinguishing sand even during the fire extinguishing work, a shortage of sand does not occur during the fire extinguishing work.

Also, since the fire extinguishing apparatus according to the present invention does not need to use a pressure container as the sand container 3, the fire extinguishing apparatus is low in manufacturing cost and is easy to handle. Although the fire extinguishing apparatus according to the present invention is suitable for fire extinction for a battery system using sodium-sulfur batteries, it is to be understood that the fire extinguishing apparatus can be used for other general fire.

DESCRIPTION OF REFERENCE SIGNS

1 Movable carriage
2 Running wheel
3 Sand container
4 Nitrogen gas cylinder
5 Ejector
6 Decompression valve
7 Suction tube
8 Delivery tube
9 Pipe
10 Nozzle
11 Lid plate
12 Sand inlet
13 Pressure regulating valve
14 Nitrogen enclosing tube
15 Relief valve
20 Battery module
21 Rack
22 Floor plate
23 Upper space
24 Door
25 Opening
26 Positioning recess
27 Guide plate

The invention claimed is:

1. A fire extinguishing apparatus comprising:

a sand container in which fire extinguishing sand is housed, the sand container having a lid plate;

a suction tube inserted into the sand container such that the suction tube is arranged at a position deviating to one side from the center of the lid plate of the sand container;

a nitrogen gas cylinder;

a nitrogen enclosing tube further reducing pressure of nitrogen gas taken out via a decompression valve from the nitrogen gas cylinder and supplying the nitrogen gas into an inside of the sand container; and an ejector to which the nitrogen gas taken out via the decompression valve from the nitrogen gas cylinder is supplied, wherein the ejector is connected to the suction tube sucking the fire extinguishing sand from the sand container with use of negative pressure generated due to a nitrogen gas stream and a delivery tube delivering the sucked fire extinguishing sand as well as the nitrogen gas, and wherein the lid plate of the sand container has a sand inlet enabling opening and closing, and wherein the sand inlet is separately formed in the lid plate such that both the lid plate and the sand inlet are configured to be airtight lids that are respectively opened and sealingly closed as needed, with the sand inlet configured to be opened separately from the lid plate to refill the sand container with fire extinguishing sand as the suction tube is sucking the fire extinguishing sand from the sand container.

2. The fire extinguishing apparatus according to claim 1, wherein the fire extinguishing sand is expanded vermiculite.

3. The fire extinguishing apparatus according to claim 1, wherein the sand container, the nitrogen gas cylinder, and the ejector are mounted on a movable carriage.

* * * * *